US009084526B2

(12) United States Patent
Assmann et al.

(10) Patent No.: US 9,084,526 B2
(45) Date of Patent: Jul. 21, 2015

(54) AUTOMATIC WAREWASHING MACHINE, IN PARTICULAR A HOUSEHOLD DISHWASHER, HAVING AN AUTOMATICALLY OPENABLE DOOR

(75) Inventors: Walter Assmann, Bielefeld (DE); David Buhl, Bielefeld (DE); Volker Marks, Bielefeld (DE); Stefan Tiekoetter, Bielefeld (DE); Cornelius Wolf, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 1107 days.

(21) Appl. No.: 13/104,040

(22) Filed: May 10, 2011

(65) Prior Publication Data

US 2011/0279004 A1 Nov. 17, 2011

(30) Foreign Application Priority Data

May 12, 2010 (DE) ..... 10 2010 016 918
Aug. 3, 2010 (EP) ..... 10401128

(51) Int. Cl.
*B08B 3/00* (2006.01)
*A47L 15/42* (2006.01)

(52) U.S. Cl.
CPC ..... *A47L 15/4259* (2013.01); *E05Y 2201/426* (2013.01); *E05Y 2201/43* (2013.01); *E05Y 2900/304* (2013.01)

(58) Field of Classification Search
CPC ..... A47L 15/4259; A47L 2501/22; A47L 2401/20; E05Y 2900/304; E05Y 2201/426
USPC ..... 134/57 DL, 58 DL, 56 D, 18, 200; 292/DIG. 69; 68/12.26
See application file for complete search history.

(56) References Cited

U.S. PATENT DOCUMENTS

| | | | | |
|---|---|---|---|---|
| 4,951,693 | A | 8/1990 | Archambault | |
| 5,901,746 | A | 5/1999 | Andersson et al. | |
| 7,607,444 | B2 * | 10/2009 | Gunnerson et al. | 134/200 |
| 2004/0103928 | A1 | 6/2004 | Kang | |
| 2004/0163684 | A1 * | 8/2004 | Hapke | 134/57 DL |
| 2006/0145485 | A1 | 7/2006 | Hapke | |
| 2006/0283482 | A1 * | 12/2006 | Berends et al. | 134/18 |
| 2011/0074261 | A1 | 3/2011 | Assmann et al. | |

FOREIGN PATENT DOCUMENTS

| | | | |
|---|---|---|---|
| DE | 1703451 | B1 | 7/1972 |
| DE | 4420775 | C1 | 8/1995 |
| DE | 19960809 | A1 | 6/2001 |
| DE | 20301951 | U1 | 6/2004 |
| DE | 102005028449 | A1 | 12/2006 |
| DE | 202007006818 | U1 | 10/2007 |

(Continued)

*Primary Examiner* — Michael Barr
*Assistant Examiner* — Thomas Bucci
(74) *Attorney, Agent, or Firm* — Leydig, Voit & Mayer, Ltd.

(57) ABSTRACT

An automatic warewashing machine includes a washing chamber, a hinged door configured to close the washing chamber, and a force-locking latching mechanism configured to hold the door in a closed position and release the door in response to a pulling force. The force-locking latching mechanism is disposed on the washing chamber or on a body enclosing the washing chamber. A door opening system is also included and has a push-open unit configured to automatically open the door to at least an ajar position. The push-open unit includes a motor-driven push-type opening bar.

14 Claims, 6 Drawing Sheets

(56) References Cited

FOREIGN PATENT DOCUMENTS

| | | | |
|---|---|---|---|
| DE | 102006054414 | B3 | 1/2008 |
| DE | 102008058257 | A1 | 6/2010 |
| EP | 1935313 | A1 | 6/2008 |
| EP | 2210547 | A1 | 7/2010 |
| WO | WO 2011003714 | A1 | 1/2001 |
| WO | WO 2009106292 | A1 | 9/2009 |
| WO | WO 2009146874 | A1 | 12/2009 |

* cited by examiner

AUTOMATIC WAREWASHING MACHINE, IN PARTICULAR A HOUSEHOLD DISHWASHER, HAVING AN AUTOMATICALLY OPENABLE DOOR

CROSS REFERENCE TO RELATED APPLICATIONS

This application claims priority to German Patent Application No. DE 10 2010 016 918.8, filed on May 12, 2010 and European Patent Application No. EP 10 401 128.3, filed on Aug. 3, 2010, both of which are hereby incorporated by reference herein in their entireties.

FIELD

The present invention relates to an automatic warewashing machine with a door that can be held in the closed position by a force-locking or force- and form-locking latching mechanism.

BACKGROUND

In automatic warewashing machines having a force-locking or force- and form-locking door lock which is disposed on the washing chamber side and may also be referred to as "pull-type release lock", it is desirable to provide a unit which allows the door to be automatically opened by a few centimeters, either by the automatic warewashing machine in a cycle-dependent manner or by the user. Cycle-dependent opening is generally performed shortly before the end of the cycle to assist in the drying process. An automatic door opening system should always be made available to the user when there is no handle that would allow the user to pull the door open. This is the case, for example, in handle-free, fully integratable appliances.

A dishwasher having an automatic door-opening system is described, for example, in DE 10 2005 028 449 A1. In this appliance, the latching mechanism is mounted on the door and adapted to engage with a latch keeper secured on the washing chamber. In order to allow the door to be automatically opened to an ajar position in a program-controlled manner, the latch keeper is mounted to a closing plate which is movable by a motor. Upon receipt of a signal from the appliance controller, the motor extends the closing plate, and thus the latch keeper. In this manner, the door is opened to an ajar position, but kept in a latched state. In order to open the door, a handle is pulled up, thereby rotating a latching member to a position where it is no longer held by the latch keeper.

In document WO 2009/146 874 A1, too, the latch keeper mounted on the washing chamber is moved by a driving mechanism to open the door to an ajar position. Here, the driving mechanism is implemented as a spring which is tensioned as the door is opened further.

The aforementioned automatic door opening devices can only be used in automatic warewashing machines where the latching mechanism is mounted in the door and the latch keeper is disposed on the washing chamber or housing of the machine. This results in disadvantages.

For example, displays or controls cannot be mounted in the middle of the door, and the space actually available for such components is limited. It is necessary to use printed circuit boards which have cutouts for the latching mechanism and, therefore, are expensive to manufacture. In addition, in the case of door-mounted latching mechanisms, the door must have a cutout, which may lead to ingress of moisture and damage to the electronics.

U.S. Pat. No. 4,951,693 also describes a dishwasher having an automatic opening system. Here, a spring mechanism becomes loaded as the door is closed, and the door is latched in the closed position. Upon release of the latch by a solenoid, the spring mechanism automatically opens the door. Additional springs hold the door in a partially open position.

A spring mechanism for opening the door to an ajar position is also used in a dishwasher as described in EP 2 210 547 A1, where a pull-type release lock is used as the latching mechanism.

During operation, the washing chamber of automatic warewashing machines should be closed liquid-tight. To this end, the access opening of the washing chamber is surrounded by a seal against which the door presses. The latching mechanism must be capable of counteracting the force with which the seal presses against the door in the opening direction. If the latching mechanism is suddenly released, such as in U.S. Pat. No. 4,951,693 A, or is overcome by spring force (see EP 2 210 547 A1), then a sudden acceleration occurs. Door springs are provided to counteract this acceleration. However, such door springs may be misadjusted or may even break. In such case, the door drops down from the closed position to the horizontal and may injure persons as it drops. Small children present in the pivoting range of the door might even be struck dead.

German Patent Application No. DE 10 2008 058 257 A1 describes an automatic washing machine where the latching mechanism is mounted in the door. This automatic washing machine is also provided with a system for automatically opening the door to an ajar position. In this system, part of the latching mechanism is moved out of the body of the machine by a motor. The door remains latched until a release device is actuated.

DE 20 2007 006 818 U1, WO 2009/106 292 A1, EP 1 935 313 A1, which are incorporated by reference herein in their entireties, describe appliance doors openable by knocking on a decorative front panel of the door.

SUMMARY

In an embodiment, the present invention provides an automatic warewashing machine including a washing chamber, a hinged door configured to close the washing chamber, and a force-locking latching mechanism configured to hold the door in a closed position and release the door in response to a pulling force. The force-locking latching mechanism is disposed on the washing chamber or on a body enclosing the washing chamber. A door opening system is also included and has a push-open unit configured to automatically open the door to at least an ajar position. The push-open unit includes a motor-driven push-type opening bar.

BRIEF DESCRIPTION OF THE DRAWINGS

Exemplary embodiments of the present invention are described in more detail below and are schematically shown in the drawings, in which.

DETAILED DESCRIPTION

Figure 1:
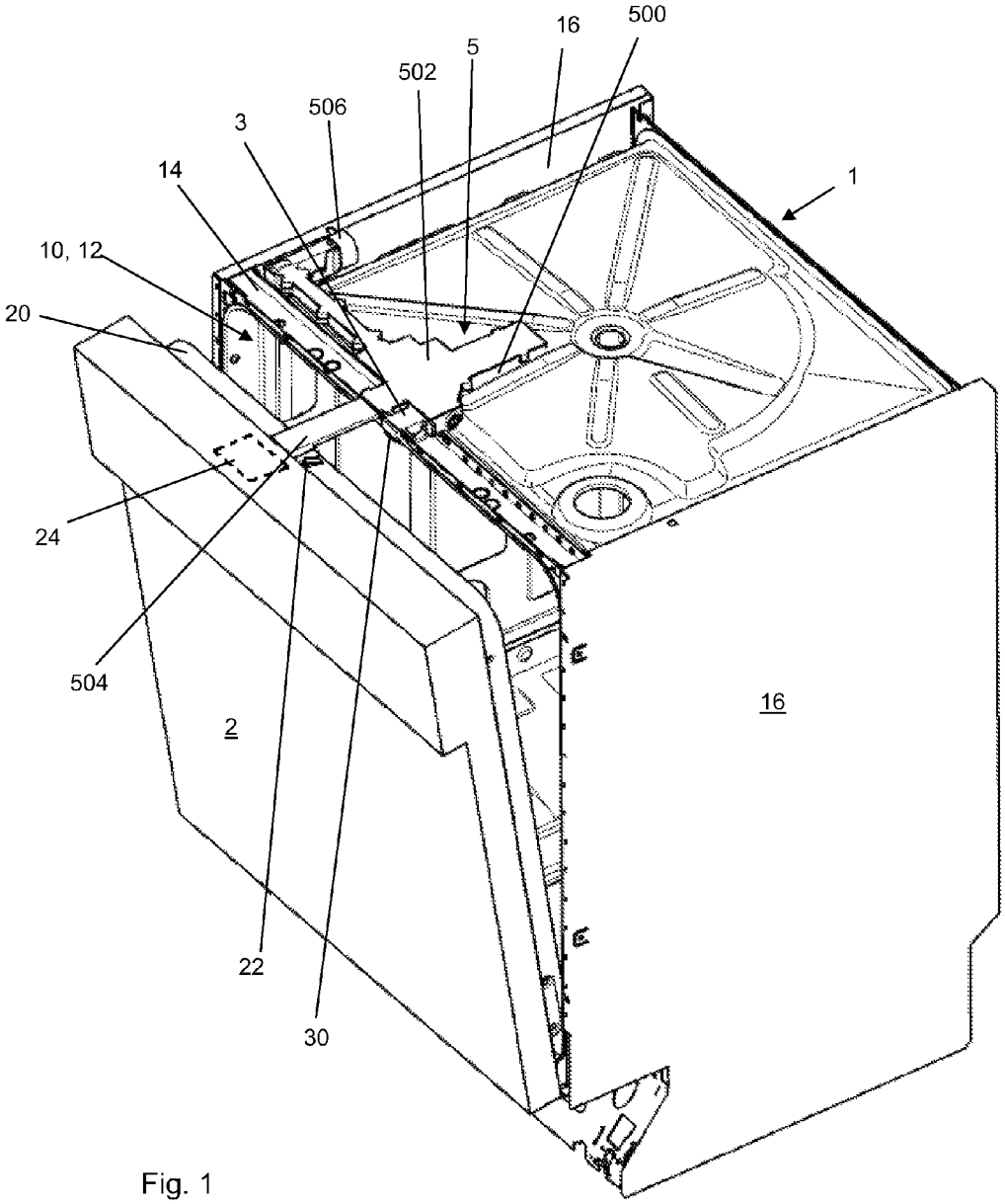
FIG. 1 is a perspective view of a dishwasher, shown with the appliance door in an ajar position.

In an embodiment, the present invention provides an automatic warewashing machine which overcomes the aforedescribed disadvantages and has an opening system that is simple in design and easy and safe to operate.

Automatic slow opening is made possible by mounting the latching mechanism on the washing chamber or on the body and providing the push-open unit with a motor-driven push-type opening bar. In this manner, the acceleration of the door during opening is kept low.

In order to provide even greater protection against excessively rapid opening of the door, the door may be retainable on the push-type opening bar by a magnetic coupling.

Furthermore, in an embodiment, the push-open unit of the present invention allows the appliance door opening to be opened at different speeds. This is advantageous in particular in the variant of a handle-free, fully integrated dishwasher. The appliance door should be opened quickly, for example, when a request for opening the door is made by knocking on the decorative front panel of the appliance door. In contrast, at the end of a cycle, the door may be opened relatively slowly. In this manner, the drying of the items washed is significantly improved (see U.S. Pat. No. 5,901,746 A, which is incorporated by reference herein in its entirety). This variation in the opening speed is made possible by the motor drive of the push-type opening bar, for which different motor variants can be used. Conveniently, a double-coil synchronous motor is used in the case of conventional dishwashers, while in the case of fully integratable dishwashers, an extra low voltage DC motor is used. As for the positioning of the motor, it is advantageous if the axis of rotation of the motor shaft extends parallel to the direction of movement of the push-type opening bar. In automatic warewashing machines of conventional design, sufficient space for accommodating a motor is available only laterally between the washing tub and the housing wall. Therefore, in particular elongated motors are preferably only be mounted in the aforesaid position.

Another advantage of embodiments of the present invention resides in the space gained on the door, which allows a deeper handle recess to be formed thereon. Besides, one locks design can be used both for appliances having an exposed control panel and for fully integrated variants. Moreover, there is no need to modify the structure of the latching mechanism for automatic warewashing machines that are not equipped with an automatic opening system. A latching mechanism having a simple design includes a resiliently mounted roller which engages with a lock catch 22 provided on the door. Further structural advantages result from the fact that the latching mechanism and the push-open unit are two independent assemblies which, therefore, can be installed and inspected independently of each other. It is also advantageous if the latching mechanism is arranged in a corner formed by the push-type opening bar and a driving shaft acting upon the push-type opening bar. In this manner, a space-saving design is achieved. The push-type opening bar and the driving shaft may be disposed in an angled housing.

Figure 2:
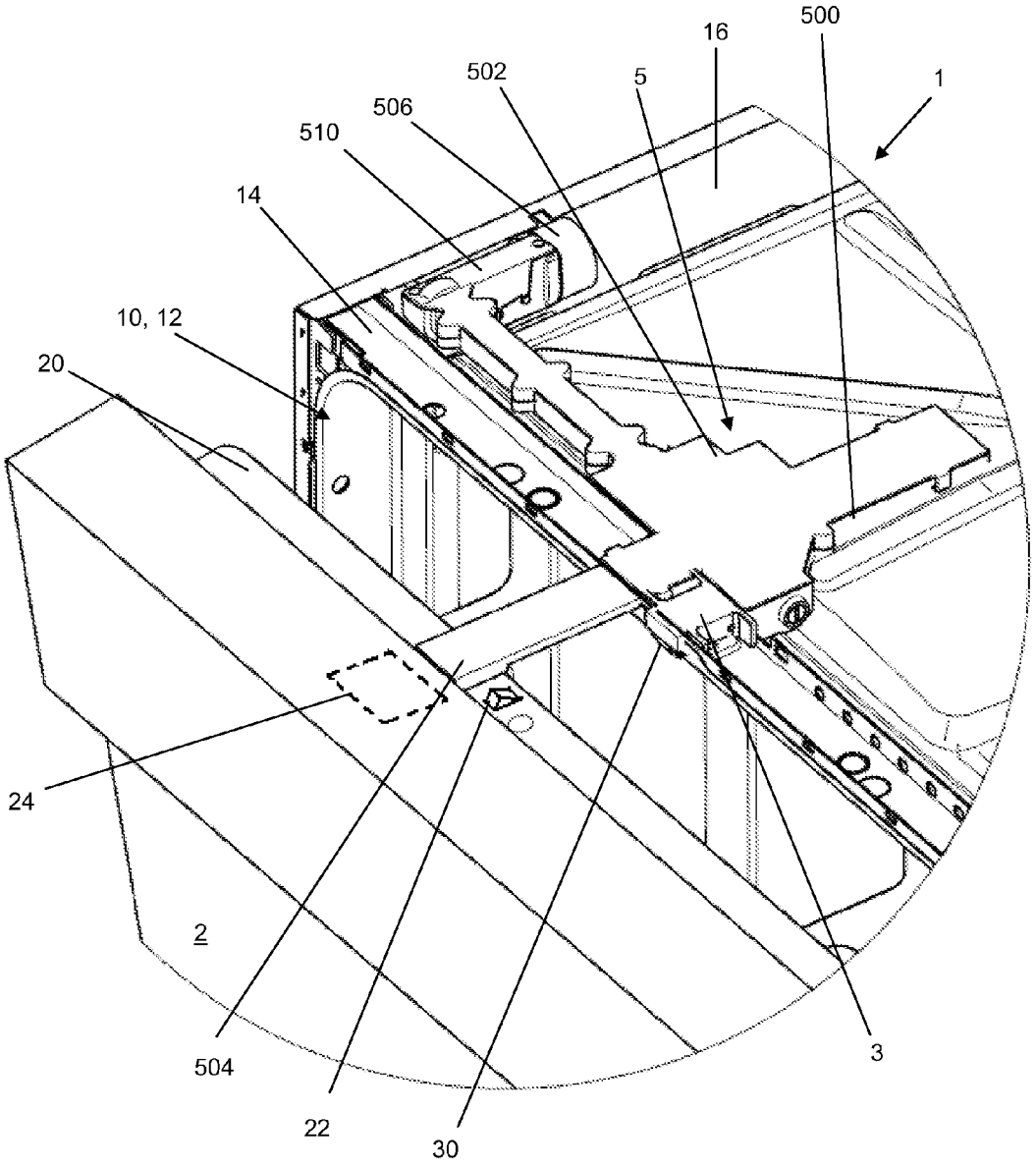
FIG. 2 is an enlarged view showing a detail of FIG. 1.

FIG. 1 shows, in a perspective view, a dishwasher 1 with an appliance door 2 in an ajar position, while FIG. 2 shows an enlarged portion of FIG. 1. In these figures, the cover of dishwasher 1 is removed to show the components of the present invention located therebelow. Door 2 closes front opening 12 of a washing chamber 10. A latching mechanism centrally disposed on the washing chamber side and hereinafter referred to as door lock 3 holds door 2 in the closed position. Dishwasher 1 further has an automatic opening system, hereinafter referred to as push-open unit 5. Door lock 3 is equipped with a resiliently supported roller 30 which engages behind a lock catch which is located opposite on the door and takes the form of a projection 22. Push-open unit 5 is disposed adjacent and to the left of door lock 3 on the washing chamber side in an angular space defined by housing parts 500 and 502, which are described elsewhere herein. The push-open unit may also be mounted on the right-hand side. Mounting push-open unit 5 on the right-hand side is advantageous in the case of narrow dishwashers 1.

Advantageously, door lock 3 is disposed centrally in a U-shaped strengthening channel 14 of washing chamber 10 of dishwasher 1. Push-open unit 5 and door lock 3 are not connected to each other and, therefore, constitute two independent assemblies, which also simplifies the development of design variants. For example, push-open unit 5 can also be used in dishwashers 1 having a force-locking door lock 3 provided on the door. Further, door lock 3 may also be used without a push-open unit 5 if required, for example, in inexpensive dishwashers 1. If the aforementioned advantages provided by the separate design of door lock 3 and push-open unit 5 are not considered essential, these two assemblies may also be combined into one unit.

FIG. 2 illustrates further structural details of embodiments of the present invention. For example, push-open unit 5 includes a push-type opening bar 504 which is mainly moved by motor 506, which is mounted laterally between dishwasher side wall 16 and the radial transition from the cover to the side wall of the washing chamber. Preferably, the axis of rotation of the shaft (indicated in FIG. 3 by a dot-dash line 508) of motor 506 extends parallel to the direction of movement of push-type opening bar 504. This advantageously allows different types of driving mechanisms (synchronous motor, DC motor) to be used in push-open unit 5. DC motors, in particular, are relatively long compared to their diameter. Here, it is only the above-described parallel mounting position within dishwasher 1 that provides a sufficient degree of freedom for installation. Moreover, this mounting position makes it possible to develop design variants. It is primarily the above-described design variant of a handle-free, fully integrated dishwasher 1 that takes advantage of a DC motor to achieve a rapid opening movement. Normally; i.e., when the purpose is to automatically open appliance door 2 in order to assist in the drying process, motor 506 is designed as a double-coil synchronous motor. Since such a motor operates at a low speed of about 250 or 500 rpm, appliance door 2 is opened relatively slowly in about 15 to 20 seconds, provided the transmission is suitably designed for this purpose. The advantages of such synchronous motors are that they feature very low operating noise levels, are inexpensive, and allow AC mains powered operation, which permits relatively easy control by the electronic cycle control. If there is a requirement for a higher door opening speed, such as, for example, to open the door of a handle-free, fully integrated dishwasher 1 toward a user, it is preferred to use an extra low voltage DC motor in place of the double-coil synchronous motor. At typical speeds of 2500 to 5000 rpm, the dishwasher door is then opened in 1.5 to 2 seconds. Preferably, the driving mechanism is designed such that push-open unit 5 can be operated with both a double-coil synchronous motor and an extra low voltage DC motor using the same transmission stages 510 (shown in FIG. 3) and without requiring any modifications.

Figure 3:
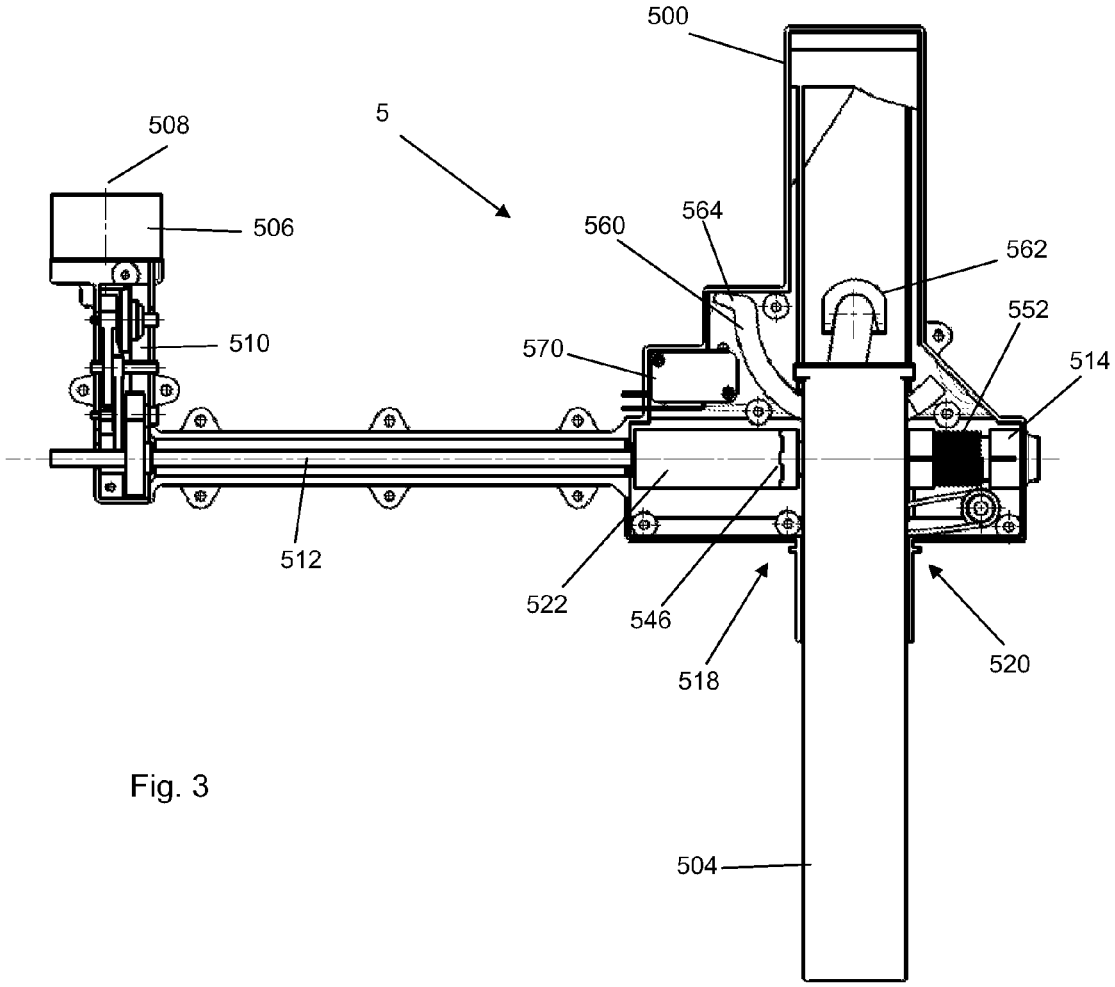
FIG. 3 is a detailed top view of a push-open unit, shown with a housing cover removed.

Further details of push-open unit 5 are shown in the top view of FIG. 3, in which housing cover 502 is removed.

Figure 4:
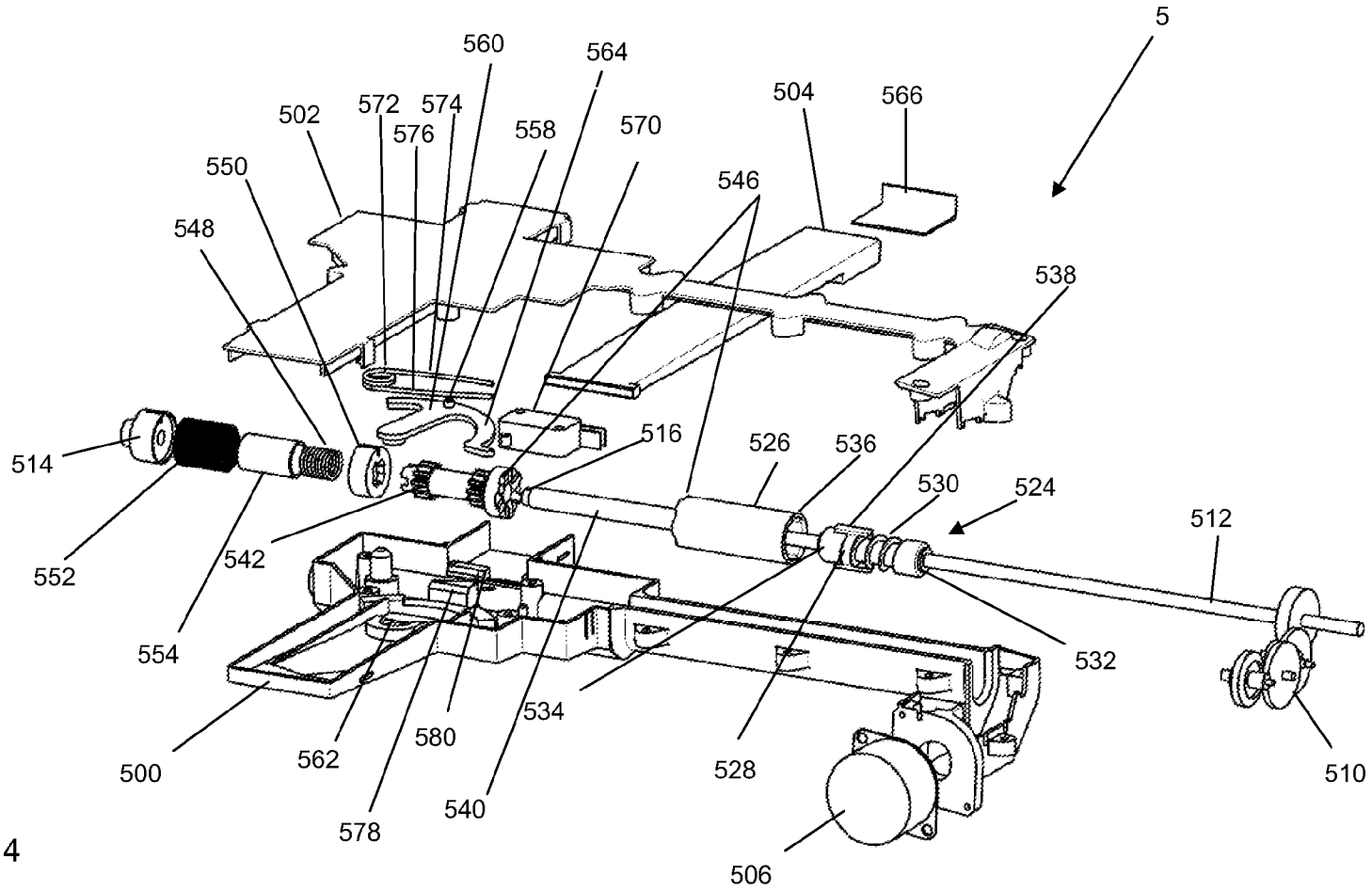
FIG. 4 is an exploded view showing structural details of the push-open unit.

The torque of motor 506 is transmitted to push-type opening bar 504 by transmission stages 510 and a shaft 512 disposed at a right angle relative to motor shaft 508 and to the direction of movement of push-type opening bar 504. Transmission stages 510, on the one hand, perform a gear reduction function; i.e., a speed-reducing function, and, on the other hand, they deflect the axis of rotation at an angle of 90° by means of a bevel gear or worm gear stage. At its left end; i.e., at its motor end, shaft 512 is supported directly in lower housing part 500. At its right end; i.e., at the opening bar end, shaft 512 is supported in lower housing part 500 via end shield 514. In FIG. 4, reference numeral 516 denotes the end of shaft 512 that is rotatably received in end shield 514. Push-type opening bar 504 and shaft 512 form two right angles 518 and 520, which are also present in housing parts 500 and 502. This is where door lock 3 is located.

FIG. 4 illustrates further structural details of embodiments of the present invention in an exploded view.

Shaft 512 has mounted thereon a freewheel 522 (FIG. 3), which is formed by an inner sleeve 524, an outer sleeve 526, and a movable slide member 528 (FIG. 4). Inner sleeve 524 is non-rotatably connected to shaft 512 and has a helical groove 530 on its surface, which moves slide member 528 during relative motion (rotation) between shaft 512 and outer sleeve 526. Helical groove 530 is bounded by a left stop 532 and a right stop 534 (as seen from a position in front of the appliance). Outer sleeve 526 concentrically surrounds shaft 512 and, consequently, is rotatably supported thereon. The outer sleeve has two guide grooves 536 arranged parallel to the shaft and adapted to receive guide ribs 538 of slide member 528. Due to the aforedescribed arrangement, slide member 528 reciprocates between the two stops 532 and 534 depending on the direction of rotation of shaft 512 and outer sleeve 526. In this manner, a freewheel 522 is created between shaft 512 and outer sleeve 526, since the rotation of shaft 512, respectively of inner sleeve 524, is not transmitted to outer sleeve 526 while the slide member moves. The number of freewheeling revolutions can be varied by the length of helical groove 530. Transmission of rotational movement from shaft 512 to outer sleeve 526 does not take place until slide member 528 reaches left stop 532 or right stop 534 (depending on the direction of rotation).

Figure 5:
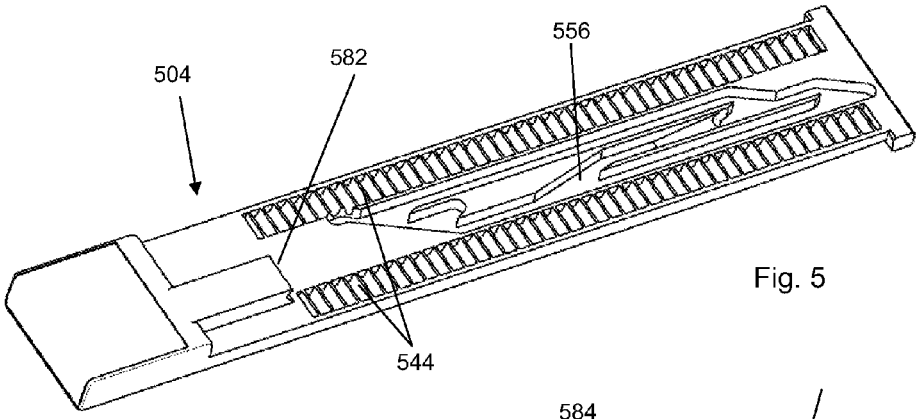
FIG. 5 is a perspective view showing the underside of a push-type opening bar.
Figure 6:
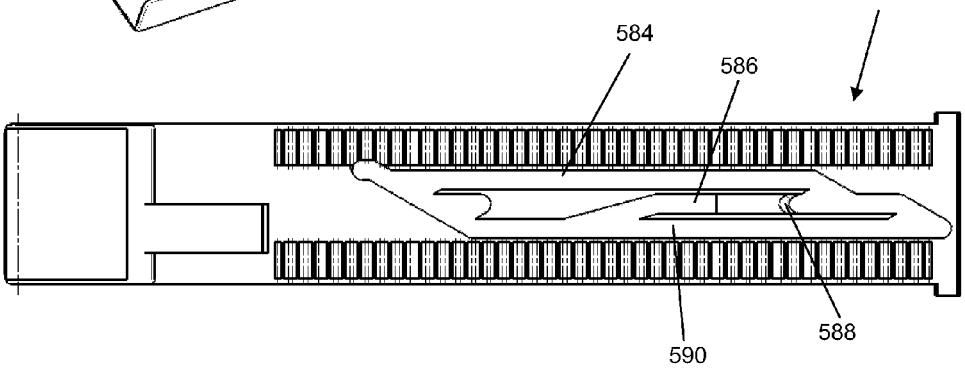
FIG. 6 is a plan view showing the underside of the push-type opening bar.
Figure 7:
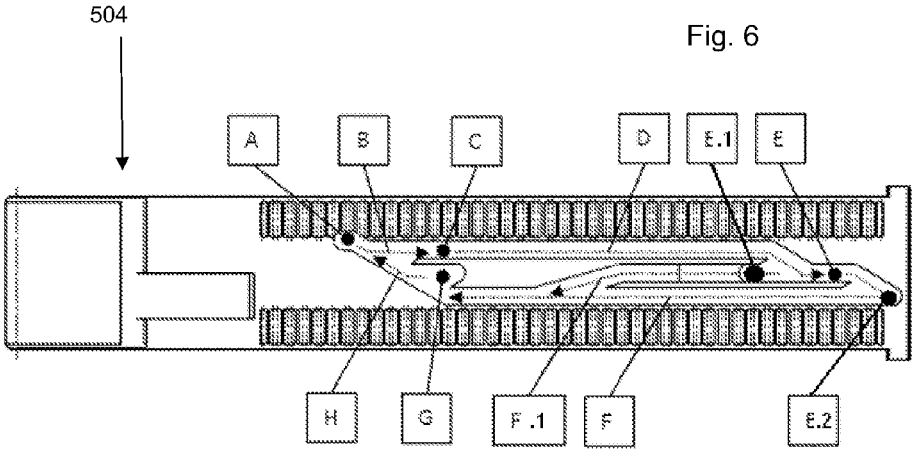
FIG. 7 is a view of the underside of the push-type opening bar, showing various points along the guide track which are indicative of discrete states.

A double pinion 542 is mounted on an extension 540 of outer sleeve 526 (FIG. 4) and meshes with lateral toothed tracks 544 formed on the underside of push-type opening bar 504 (see FIGS. 5 through 7). Double pinion 542 is driven by outer sleeve 526 of freewheel 522 via meshing facial toothings 546. Facial toothings 546 are pressed together by a compression spring 548 via a drive dog 550 and double pinion 542. In this manner, a mechanical safety coupling; i.e., a slip coupling, is created. The torque transmittable by the slip coupling can be adjusted via the helix angle of facial toothings 546 and the force of compression spring 548. A torsion spring 552 is mounted on a spring sleeve 554 concentrically around compression spring 548 between end shield 514 and drive dog 550. The function of this torsion spring will be explained later herein.

Double pinion 542 drives push-type opening bar 504 which, in order to open appliance door 2, presses into the rabbet of inner door panel 20, releasing roller 30 of door lock 3 from lock catch 22. The underside of push-type opening bar 504 has a guide track 556 formed between lateral toothed tracks 544. Guide track 556 is engaged by a locking pin 558 formed on an anchor member 560 (see FIG. 4 in conjunction with FIG. 5). Anchor member 560 is pivotally mounted in a receiving formation 562 in lower housing part 500 and has two functions. First, it retains push-type opening bar 504 in particular positions via locking pin 558 (in this regard, see the description of FIG. 7 in section "Sequence of Operation"). Second, it actuates a microswitch 570 via an arm 564 when push-type opening bar 504 has moved to its end position in housing (500, 502). Microswitch 570 is polled by a controller of dishwasher 1. Preferably, if motor 506 is a synchronous motor or a double-coil synchronous motor, all further positions of push-type opening bar 504 that are different from its rear end position are approached in a time-controlled manner. Alternatively, in particular if motor 506 is an extra low voltage DC motor, all further positions of push-type opening bar 504 that are different from its rear end position can be sensed by one or more additional microswitches.

All other functions provided by the interaction of locking pin 558 with guide track 556 on the underside of push-type opening bar 504 are also described below.

Appliance door 2 is opened by about 100 mm as push-type opening bar 504 is moved out. Door 2 is magnetically held in this state. To this end, a ferromagnetic metal insert 566 is attached to push-type opening bar 504, and a magnet 24 is disposed at a corresponding position behind the inner door panel so as to cooperate with one another. During automatic opening of appliance door 2, the magnetic holding means ensure that the door is retained in the event it has a tendency to open by itself. This may be necessary, for example, if the door springs are set too weak or are broken. Once the ajar position is reached during automatic opening, the user can fully open the door for unloading and loading of dishware. After the magnetic holding means are separated, push-type opening bar 504 should in any case be returned to the retracted position, even if the user has already turned off dishwasher 1, disconnecting it from the mains power supply. Otherwise there would be a risk of getting injured by the extended push-type opening bar 504 or of damaging the same. In addition, the extended push-type opening bar would hinder the unloading and unloading of dishware.

In order to achieve this, torsion spring 552 located on spring sleeve 554 is tensioned as push-type opening bar 504 is moved out; i.e., during the automatic opening of the door. To this end, spring 552 is secured at its two ends in receptacles on drive dog 550 and end shield 514. As appliance door 2 is fully opened by the user, the aforedescribed magnetic holding means cause push-type opening bar 504 to be pulled out up to a front limit stop. Then, push-type opening bar 504 detaches from door 2 and is retracted by torsion spring 552. This also works when dishwasher 1 is off, which makes it possible to avoid standby consumption, which would be required in alternative, electric motor based approaches for the then required control electronics. Spring sleeve 554 allows compression spring 548 and torsion spring 552 to be arranged on shaft 512 in a space-saving manner and concentrically within one another; i.e., concentrically one over the other. End shield 514, which is rotatably disposed in lower housing part 500, serves to support shaft 512 and to adjust the bias of torsion spring 552.

Push-type opening bar 504 is provided with a resilient stop to allow easy opening of the door by the user during periods when no washing operation takes place, such as in a situation where the washed dishes have been unloaded and new items to be washed need to be loaded. This is achieved by means of a stop spring 572. The two legs 574 and 576 of stop spring 572 are biasingly clamped between two bearing blocks 578 and 580. Front leg 574 can be pressed by about 15 mm rearward by stop 582 of push-type opening bar 504. When the user closes the door, stop 582 of push-type opening bar 504 first contacts front leg 574, and the lock is at the changeover point. In the further sequence of movements, the user pushes the door by about another 5 mm rearward, and roller 30 of door lock 3 drops behind lock catch 22. When appliance door 2 is closed, the so-biased push-type opening bar 504 presses with a force of, for example, 25 N from behind against the door, so that the spring force of push-type opening bar 504 counteracts the closure force of door lock 3, which is 40 N, for example. In this example, the resulting reduced closure force of door lock 3 would be 15 N. Thus, the user can open appliance door 2 particularly easily. When the wash cycle is initiated, the driving mechanism presses push-type opening bar 504 by another 10 mm to the rear end position against the force of stop spring 572, so that it no longer contacts the door. Now, the full closure force of 40 N is exerted by door lock 3 on door 2, which is the force required to ensure tightness of the door seal, so that now the washing operation can be started.

A description of the automatic opening sequence and the subsequent closing operation will be given with reference to FIG. 7. Table 1 below gives a brief overview of this sequence of operation. FIG. 7 is a view of the underside of push-type opening bar 504, showing the positions of locking pin 558 within guide track 556. The points denoted by position characters indicate states, while the arrows denoted by position characters indicate transitions between two states. Locking pin 558 is guided in upper guide slot 584, middle guide slot 586 or in lower guide slot 590.

During the washing operation, door 2 is closed; push-type opening bar 504 has been retracted to its end position by the driving mechanism formed by motor 506 and transmission stage 510. There is no contact between door 2 and bar 504. The driving mechanism is at rest; freewheel 522 is located at left stop 532. Locking pin 558 is in position A, and arm 564 of anchor member 560 actuates microswitch 570. To initiate the automatic opening, the driving mechanism is activated, causing push-type opening bar 504 to be released. In this process, stop spring 572 pushes push-type opening bar 504 out of housing 500 and 502. Arm 564 clears microswitch 570, and locking pin 558 moves via B to C. In position C, push-type opening bar 504 has moved out 15 mm, which corresponds to the travel of spring 572. Opening bar 504 initially remains in this position, while freewheel 522 is traversed from left stop 532 to right stop 534. Once right stop 534 is reached, double pinion 542 moves opening bar 504 further in the forward direction; locking pin 558 moves via position D to position E, changing from upper guide slot 584 to middle guide slot 586 in the process. When arrived there, the driving mechanism is reversed and freewheel 522 is traversed from right stop 534 back to left stop 532. Once the entire path through freewheel 522 is traversed, the driving mechanism is stopped. Depending on the adjustment of the door springs, door 2 remains in its position, is slightly pulled back by tensioned torsion spring 552 via opening bar 504, or opens a little further by itself. Accordingly, locking pin 558 either remains in position E, moves to position E.1 (if door 2 is pulled back), or moves to position E.2 (if door 2 opens a little further by itself). Middle guide slot 586 has a bevel 588 at point E.1. When the user presses door 2 closed when in the automatically opened position with push-type opening bar 504 in the extended position, locking pin 558 moves up this bevel as push-type opening bar 504 is pushed in, and then moves through path F.1 to position G. Because anchor member 560 is freely supported in the region of locking pin 558, it allows for the lifting of locking pin 558 on the higher, middle guide slot. As path F.1 is traversed, the torsion spring relaxes, and freewheel 522 is traversed from left stop 532 to right stop 534. Normally, the user will pull the door further open after the automatic opening operation is completed. In this process, push-type opening bar 504 is initially pulled further out by the magnetic coupling until the locking pin reaches point E.2. Then, the magnetic coupling is disconnected. Tensioned torsion spring 552 then pulls opening bar 504 back into housing 5, in which process the locking pin moves, via F, from middle guide slot 586 to lower guide slot 590 and to G, where it is held. As opening bar 504 retracts, freewheel 522 is traversed from left stop 532 to right stop 534. Position G in the middle guide slot is configured as a receptacle in which locking pin 558 is held. Because of this, upon manual opening of the closed door, push-type opening bar 504 is held in this position and prevented from also moving out. Once a new wash cycle is initiated, opening bar 504 is fully retracted again, and locking pin 558 moves via H onto upper guide slot 584 and back to position A. In this process, the freewheel is traversed from right stop 534 to left stop 532.

Figure 8:
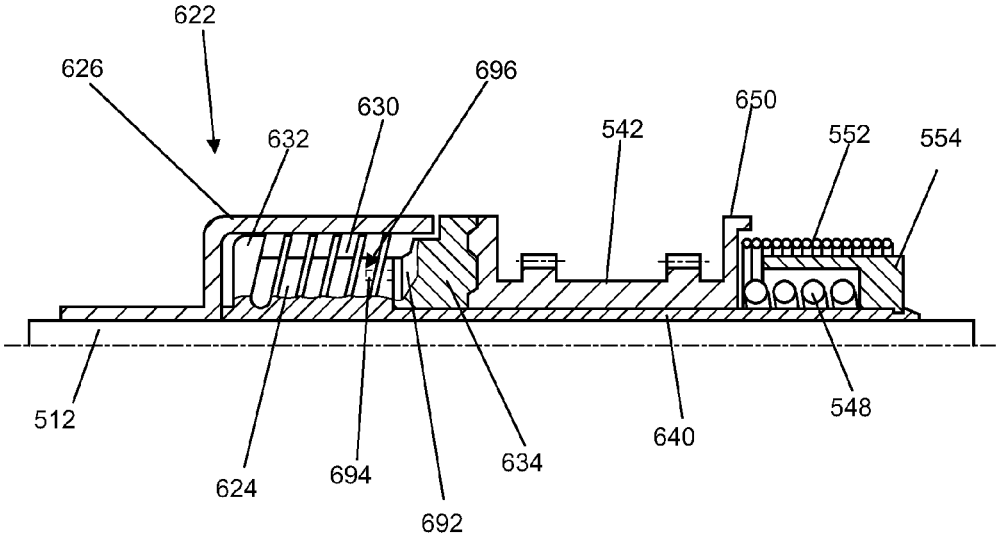
FIG. 8 is a view of an alternative embodiment of a freewheel.
Figure 9:
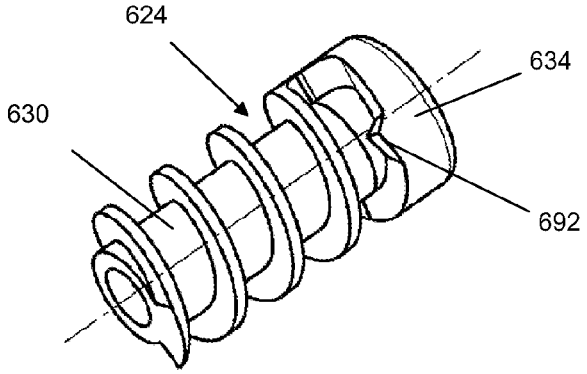
FIG. 9 is a detail view of the inner sleeve of the freewheel shown in FIG. 8.

FIGS. 8 and 9 show an alternative embodiment of a freewheel 622. In contrast to the aforedescribed variant, this variant provides protection against the following failure:

Door 2 is pulled down to the horizontal position by its own weight already when in a slightly open state. The weight of door 2 is counteracted by conventional door springs. However, when one or even both door springs are broken, the weight is not or not sufficiently balanced anymore. In this case, door 2 is initially held by torsion spring 552 as push-type opening bar 504 moves out. When at a certain opening angle, the weight of door 2 exceeds the retaining force of spring 552, the door accelerates its dropping motion. In the first variant of freewheel 522, the freewheel is traversed from right stop 534 to left stop 532 in this process, and push-type opening bar 504 is fully pulled out up to the stop. The acceleration occurring in this process, and the subsequent sudden deceleration occurring when push-type opening bar 504 reaches the end of its path, may disconnect the coupling between metal insert 566 and magnet 24. In that case, door 2 continues to drop unbraked to the horizontal position and may injure persons or destroy objects on its way.

To avoid this, the variant of freewheel 622 shown in FIGS. 8 and 9 is latched in its position at right stop 634. To this end, unlike the first variant, an outer sleeve 626 is non-rotatably fixed to shaft 512 at the drive end. An inner sleeve 624 is partially received within outer sleeve 626 and is rotatably supported on shaft 512. Inner sleeve 624 merges into an extension 640 having double pinion 542, compression spring 548, torsion spring 552 and spring sleeve 554 slidably supported thereon. The drive dog for attachment of torsion spring 552 is here in the form of a hook 650 integrally formed on double pinion 542. End shield 514 and slide member 528 are not shown here, but function in the same way as in the first variant. Besides the laterally reversed arrangement of inner sleeve 624 and outer sleeve 626, a main difference of the second freewheel variant is the separation of right stop 634 from the remainder (left stop 632 and helical groove 630) of inner sleeve 624, and the provision of left stop 632 with a latch bevel 692, which is engageable with slide member 528. Right stop 634 has a pin 694, which engages in a hole 696. In this manner, stop 634 and the remainder of inner sleeve 624 are indeed non-rotatably connected to each other, but remain axially movable relative to each other. If slide member 528 now moves through freewheel 622 up to right stop 634 in response to activation of the driving mechanism, it moves up the latch bevel 692. In this process, the slide member presses right stop 634 toward the right against the compression spring and moves beyond the falling portion of latch bevel 692. In this manner, slide member 528 is fixed in position and locks freewheel 622. Then, door 2 can only be moved by the driving mechanism, and automatic opening and the acceleration involved are prevented. When outer sleeve 626 is rotated in the opposite direction by the driving mechanism, and freewheel 622 is traversed from the right to the left, freewheel 622 is released from the locked state.

While the invention has been particularly shown and described with reference to preferred embodiments thereof, it will be understood by those skilled in the art that various changes in form and details may be made therein without departing from the spirit and scope of the invention.

20 inner door panel
22 lock catch
24 door magnet
3 door lock (latching mechanism)
30 roller
5 push-open unit
500 lower housing part
502 housing cover
504 push-type opening bar
506 motor
508 motor shaft
510 transmission stages
512 shaft
514 end shield
516 shaft end

TABLE 1

Positions of locking pin (558) and sequence of operation

| Position | Appliance Status | Driving Mechanism | | Freewheel | Opening Bar | | Force exerted by Opening Bar on Lock | Force exerted by Lock | Total Locking Force | Retaining Pin | Micro-switch |
|---|---|---|---|---|---|---|---|---|---|---|---|
| A | washing | at rest | ▬ | at left stop | in rear position | ▬ | 0 N | −40 N | −40 N | special position for micro-switch | 1 |
| B | start of door opening operation | rotates counter-clockwise | ↺ | " | moves out | → | 0 N to 20 N | −40 N | −40 N to −20 N | no function | 0 |
| C) | continued opening | rotates counter-clockwise | ↺ | is traversed from left to right | extends 15 mm out | ▬ | 20 N | " | −20 N | no function | 0 |
| D | continued opening | rotates counter-clockwise | ↺ | at right stop | moves out | → | 20 N to 0 N | −40 N to 15 N | −20 N to 15 N | no function | 0 |
| E, E.1 or E.2 | end of door opening operation | rotates clockwise | ↻ | is traversed from right to left | extends 90 mm out | ▬ | 0 N | 0 N | 0 N | holds opening, bar in locked position "Hold/ Door Open" | 0 |
| F | regular opening/ closing of door | at rest | ▬ | is traversed from left to right | moves in assisted by spring force | ← | 0 N to 20 N | 15 N to −40 N | 15 N to −20 N | moves to stop position | 0 |
| F0.1 | user presses door closed | at rest | ▬ | is traversed from left to right | moves in assisted by spring force | ← | 0 N to 20 N | 15 N to −40 N | 15 N to −20 N | is pushed over the ramp | 0 |
| G | assisted door-opening force | " | ▬ | is traversed bi-directionally | extends 15 mm out | ▬ | 20 N | −40 N | −20 N | holds opening bar in locked position "Hold" | 0 |
| H | goes to washing position | rotates clockwise | ↻ | is traversed from right to left | moves completely in | ← | 20 N to 0 N | −40 N | −20 N to −40 N | no function | 0 |

Definition of forces:
Force vectors having a positive sign in front point out of the washing chamber;
force vectors having a negative sign in front point into the washing chamber.

LIST OF REFERENCE NUMERALS

1 dishwasher
10 washing chamber
12 access opening of the washing chamber
14 strengthening channel
16 dishwasher side wall
2 door
518 right angle between the shaft and to the push-type opening bar
520 right angle between the shaft and to the push-type opening bar
522 freewheel
524 inner sleeve
526 outer sleeve
528 slide member

530 helical groove
532 left stop
534 right stop
536 guide grooves for the slide member
538 guide ribs of the slide member
540 extension of the outer sleeve
542 double pinion
544 lateral toothed tracks of the push-type opening bar
546 facial toothing
548 compression spring
550 drive dog
552 torsion spring
554 spring sleeve
556 guide track
558 locking pin
560 anchor member
562 receiving formation for the anchor member
564 arm of the anchor member
566 ferromagnetic metal insert
570 microswitch
572 stop spring
574 front leg
576 rear leg
578 front bearing block
580 rear bearing block
582 stop of the push-type opening bar
584 upper guide slot
586 middle guide slot
588 bevel
590 lower guide slot
622 second freewheel variant
624 inner sleeve
626 outer sleeve
630 helical groove
632 left stop
634 right stop
640 extension
650 hook
692 latch bevel
694 pin of the anti-rotation feature
696 hole of the anti-rotation feature

What is claimed is:

1. An automatic warewashing machine comprising:
a washing chamber;
a hinged door configured to close the washing chamber;
a force-locking latching mechanism disposed on the washing chamber or a body enclosing the washing chamber, the force-locking latching mechanism being configured to hold the door in a closed position and release the door in response to a pulling force; and
a door opening system including a push-open unit configured to automatically open the door to at least an ajar position, the push-open unit including:
a motor;
a motor-driven push-type opening bar being extendable to open the door, the door and the push-type opening bar being releasably coupled to one another; and
a spring configured to be tensioned by the motor as the motor extends the push-type opening bar and to retract the push-type opening bar when the releasable coupling between the door and the push-type opening bar is released.

2. The automatic warewashing machine recited in claim 1, wherein the machine is configured as a dishwasher.

3. The automatic warewashing machine recited in claim 1, further comprising a magnetic coupling configured to retain the door on the push-type opening bar.

4. The automatic warewashing machine recited in claim 1, wherein the motor is a synchronous motor.

5. The automatic warewashing machine recited in claim 3, wherein the motor is a synchronous motor.

6. The automatic warewashing machine recited in claim 1, wherein the warewashing machine is a fully integratable dishwasher, and the motor is an extra low voltage DC motor.

7. The automatic warewashing machine recited in claim 3, wherein the warewashing machine is a fully integratable dishwasher, and the motor is an extra low voltage DC motor.

8. The automatic warewashing machine recited in claim 1, wherein the motor includes a motor shaft having an axis of rotation that extends parallel to a direction of movement of the push-type opening bar.

9. The automatic warewashing machine recited in claim 3, wherein the motor includes a motor shaft having an axis of rotation that extends parallel to a direction of movement of the push-type opening bar.

10. The automatic warewashing machine recited in claim 4, wherein the motor includes a motor shaft having an axis of rotation that extends parallel to a direction of movement of the push-type opening bar.

11. The automatic warewashing machine recited in claim 6, wherein the motor includes a motor shaft having an axis of rotation that extends parallel to a direction of movement of the push-type opening bar.

12. The automatic warewashing machine recited in claim 1, further comprising a lock catch disposed on the door, and wherein the force-locking latching mechanism includes a resiliently mounted roller configured to engage the lock catch.

13. The automatic warewashing machine recited in claim 1, further comprising a shaft configured to act on the push-type opening bar, wherein the push-type opening bar and the shaft form a corner, and wherein the force-locking latching mechanism is disposed in the corner.

14. The automatic warewashing machine recited in claim 13, wherein the push-type opening bar and the shaft are disposed in an angled housing.

* * * * *